US009385488B2

(12) United States Patent
Qi et al.

(10) Patent No.: US 9,385,488 B2
(45) Date of Patent: Jul. 5, 2016

(54) CONNECTOR HAVING IMPROVED INNER BOARD

(71) Applicant: FOXCONN INTERCONNECT TECHNOLOGY LIMITED, Grand Cayman (KY)

(72) Inventors: Feng-Jun Qi, Hefei (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/605,962

(22) Filed: Jan. 26, 2015

(65) Prior Publication Data

US 2015/0214651 A1 Jul. 30, 2015

(30) Foreign Application Priority Data

Jan. 24, 2014 (CN) ..... 2014 1 0032883

(51) Int. Cl.

| | |
|---|---|
| ***H01R 12/24*** | (2006.01) |
| ***H01R 13/66*** | (2006.01) |
| ***H01R 12/72*** | (2011.01) |
| *H01R 107/00* | (2006.01) |

(52) U.S. Cl.

CPC ..... *H01R 13/6658* (2013.01); *H01R 12/721* (2013.01); *H01R 2107/00* (2013.01)

(58) Field of Classification Search

CPC ..... H01R 13/6858
USPC ..... 439/76.1, 483
See application file for complete search history.

(56) References Cited

U.S. PATENT DOCUMENTS

| | | | | |
|---|---|---|---|---|
| 5,766,027 | A * | 6/1998 | Fogg | H01R 13/6658 439/76.1 |
| 5,957,727 | A * | 9/1999 | Page, Jr. | H01R 13/5845 439/607.58 |
| 6,431,887 | B1 | 8/2002 | Yeomans et al. | |
| 6,585,528 | B1 * | 7/2003 | Lin | H01R 9/0515 439/76.1 |
| 6,854,987 | B2 * | 2/2005 | Wu | H01R 13/6585 439/108 |
| 7,297,028 | B2 * | 11/2007 | Daikuhara | G02B 6/4246 439/577 |
| 7,597,488 | B2 * | 10/2009 | Fisher | G02B 6/4292 385/91 |
| 7,922,520 | B2 * | 4/2011 | Mizukami | H01R 13/6658 439/493 |
| 8,303,342 | B2 * | 11/2012 | Shi | H01R 24/60 439/607.41 |
| 8,926,339 | B2 * | 1/2015 | Houtz | H01R 13/5045 439/76.1 |
| 9,077,101 | B2 * | 7/2015 | Wu | H01R 12/53 |

* cited by examiner

*Primary Examiner* — Neil Abrams
(74) *Attorney, Agent, or Firm* — Wei Te Chung; Ming Chieh Chang

(57) ABSTRACT

A connector (100) comprises a housing (1), an inner board (3) and a number of contacts (2) supported by the housing. The housing has a base portion (11), a first (16) and second side wall (15). The base portion defines a receiving cavity (14) for receiving a mating connector along a front-to-back direction. The first (16) and second side wall (15) are parallel to each other and backwardly extending from the base portion to defining a mounting room (17). The inner board is inserted into the mounting room along a back-to-front direction. The inner board has a first flange (37) cooperated with the first side wall, and a second flange (36) cooperated with the second side walls. The first side wall has a length greater than the second wall, and the first flange has a length smaller than the second flange. This relationship is used to prevent incorrect orientation of the inner board in the housing.

20 Claims, 8 Drawing Sheets

CONNECTOR HAVING IMPROVED INNER BOARD

BACKGROUND OF THE INVENTION

1. Field of the Invention

The present invention relates to a cable end electrical connector having an improved inner printed circuit board.

2. Description of Related Art

U.S. Pat. No. 8,303,342, issued to Shi et al. on Nov. 6, 2012, discloses a cable end electrical connector having an inner printed circuit board (PCB). The connector further has a housing adapted to support the inner PCB, a cable electrically connected with a rear portion of the inner PCB, and a number of contacts mounted into the housing and connected with a front region of the inner PCB. The housing defines a pair of side walls extending backwardly from a base portion so as to form a U-shaped receiving room for mounting the inner PCB. Each of the side walls has a same length along the mating direction, and the PCB has a substantially symmetrical shape. Although the PCB has a sloped corner configured for engaging with a sloped notch in the receiving room to avoid mis-mating, it is difficult to judge which side upon is correct until the inner PCB is almost completely inserted. Thus, the inner PCB might be inserted at an incorrect orientation.

U.S. Pat. No. 6,431,887, issued to Yeomans et al. on Aug. 13, 2002, discloses an electrical connector having a PC board enclosed within an upper shell and a lower shell. The PC board includes a configuration of keying projections and notches configured to fit between keys and sides of the lower shell. When the PC board is positioned downwardly into the lower shell, the keying projections, notches and keys cooperate to insure that the board is placed with the top surface pointed upward. The PC board if previously assembled with contacts extending outwardly and forwardly is not easy to handle and moreover the keying projections and notches does not permit the PC board to be inserted into the lower shell from a back-to-front direction.

Hence, an electrical connector having an improved inner board is desired.

SUMMARY OF THE INVENTION

Accordingly, an object of the present invention is to provide a cable end electrical connector. The connector includes a number of contacts, and an inner printed circuit board. The housing has a base portion, a first side wall, and a second side wall. The base portion has a receiving cavity for receiving a mating connector along a front-to-back direction. The first side wall and the second side wall are parallel to each other and backwardly extending from the base portion to defining a mounting room. The contacts are supported by the housing. Each contact has a mating portion exposed into the receiving cavity, a mounting portion extending into the mounting room. The inner board is inserted into the mounting room along a back-to-front direction for supporting the mounting portion of the contact. The inner board has a first flange cooperated with the first side wall, and a second flange cooperated with the second side wall. The first side wall has a length greater than the second wall, and the first flange has a length smaller than the second flange in the front-to-back direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
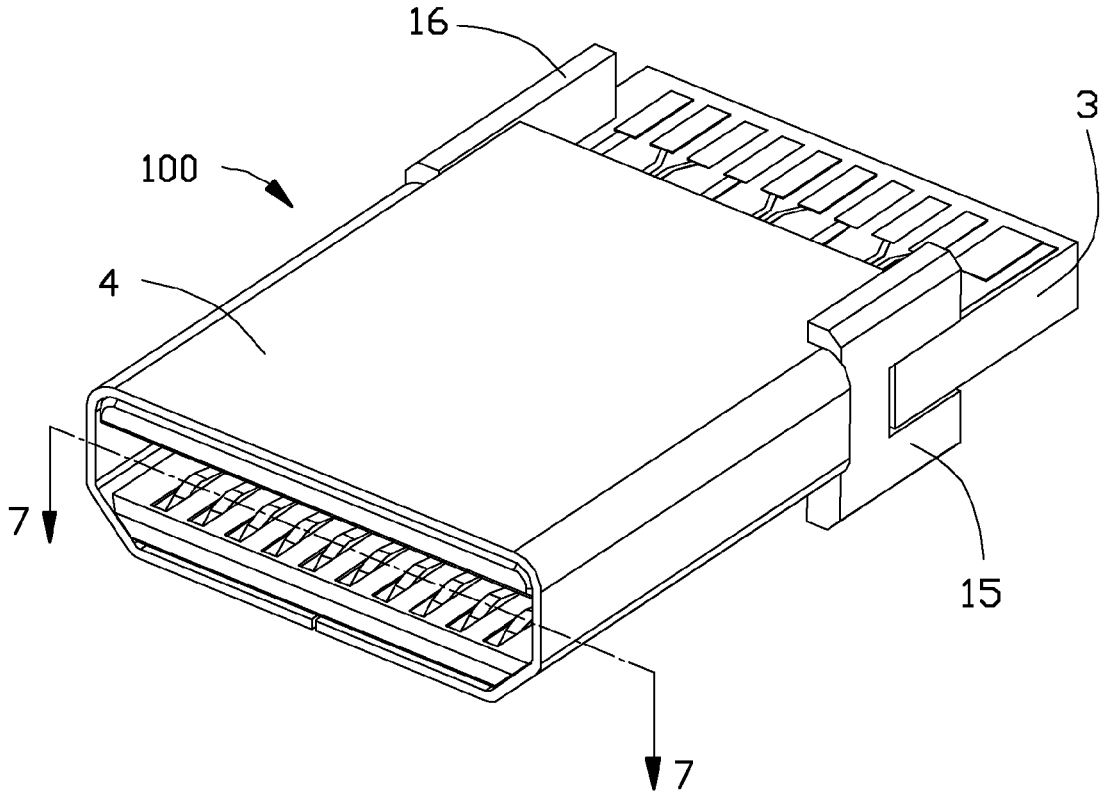
FIG. 1 is an assembled perspective view of an electrical connector in accordance with the present invention.
Figure 2:
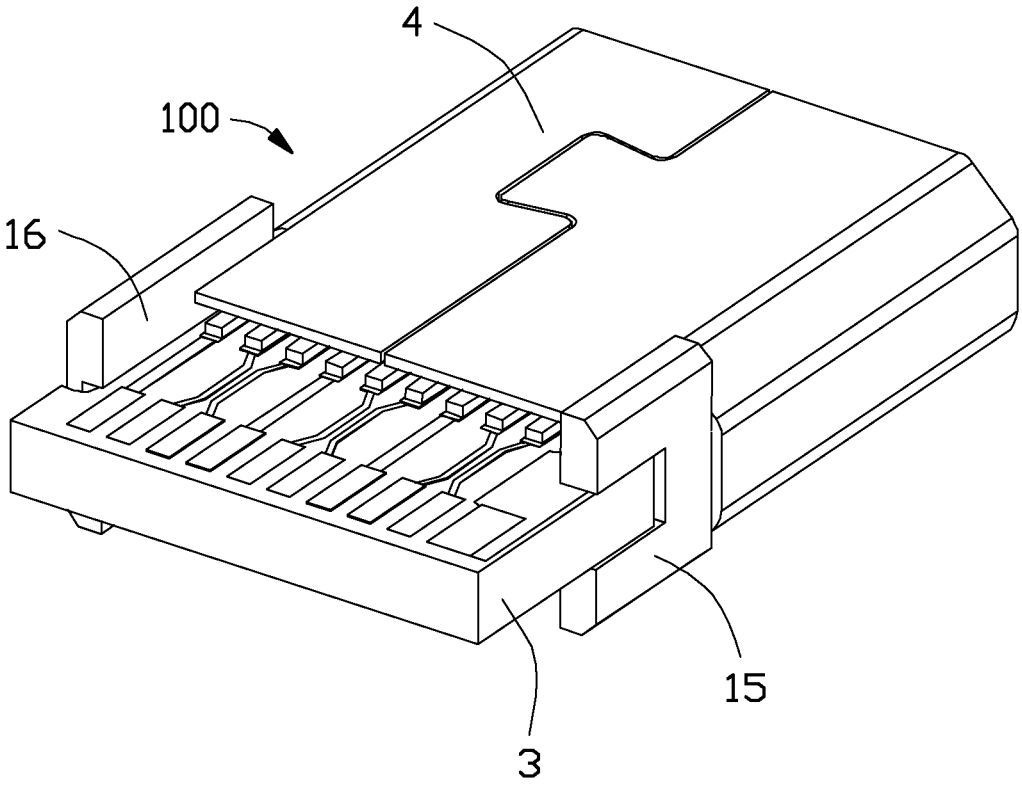
FIG. 2 is an assembled perspective view of the electrical connector shown in FIG. 1, viewed from another aspect.
Figure 3:
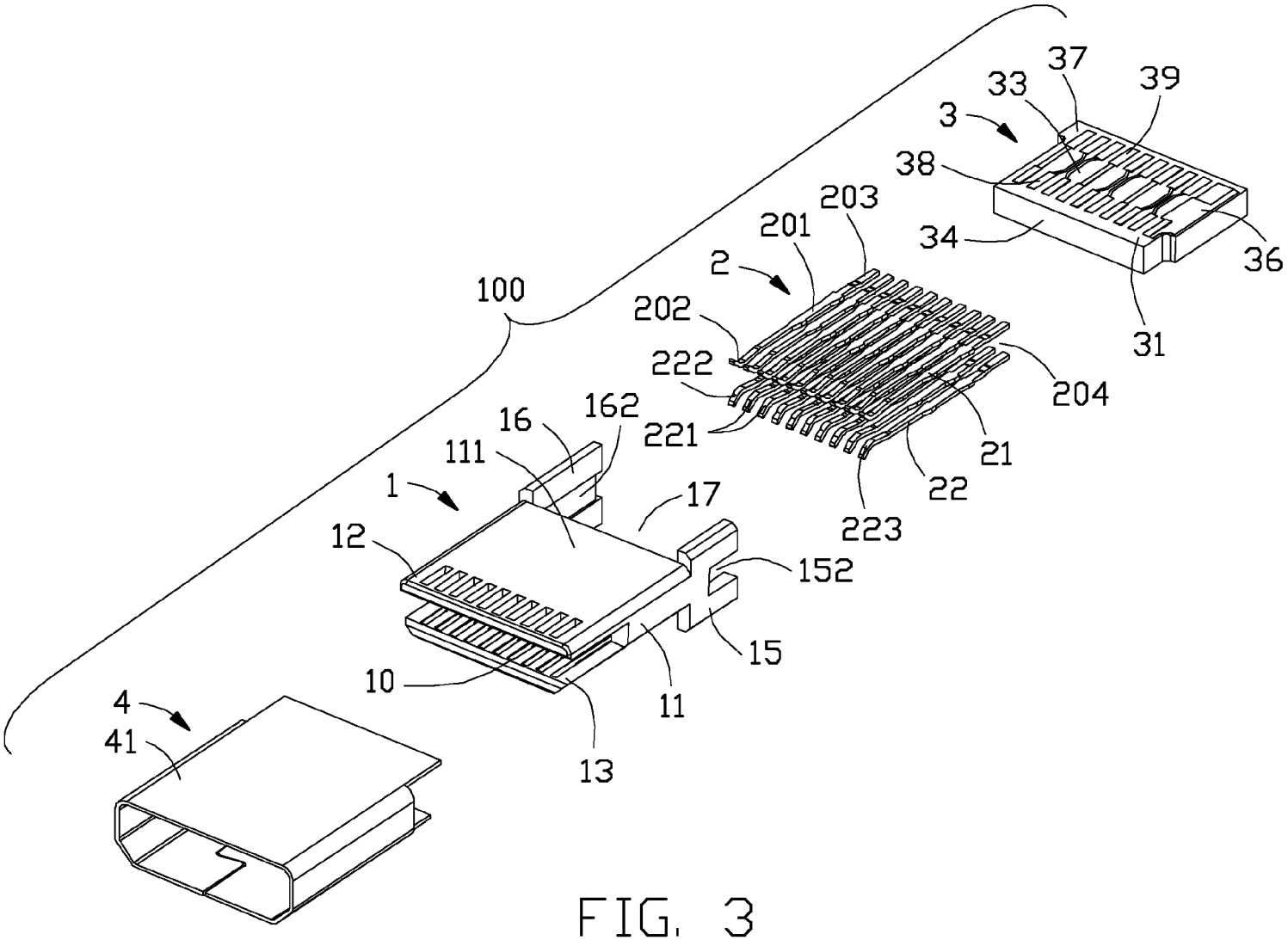
FIG. 3 is an exploded perspective view of the electrical connector as shown in FIG. 1.
Figure 4:
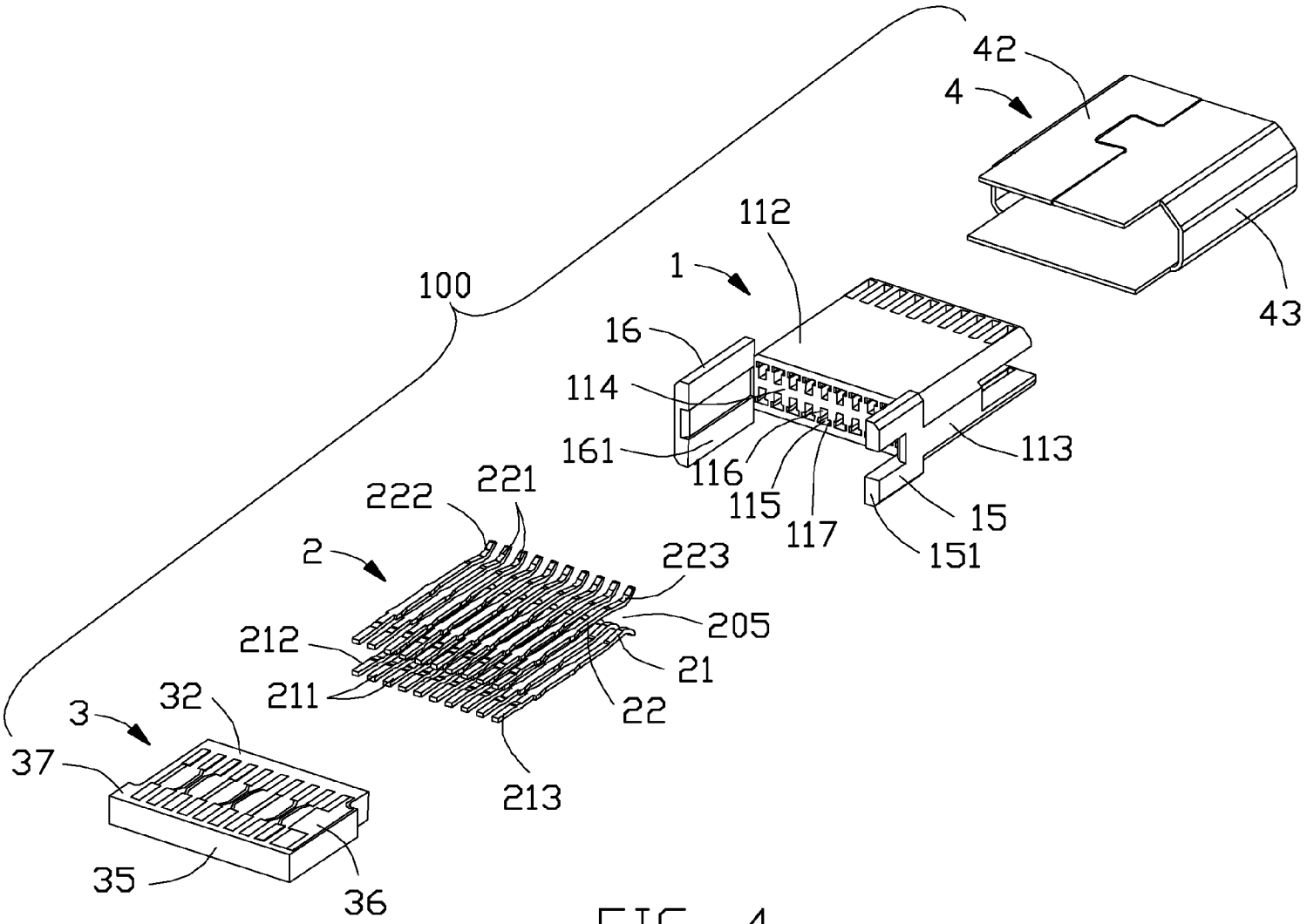
FIG. 4 is an exploded perspective view of the electrical connector as shown in FIG. 2.
Figure 5:
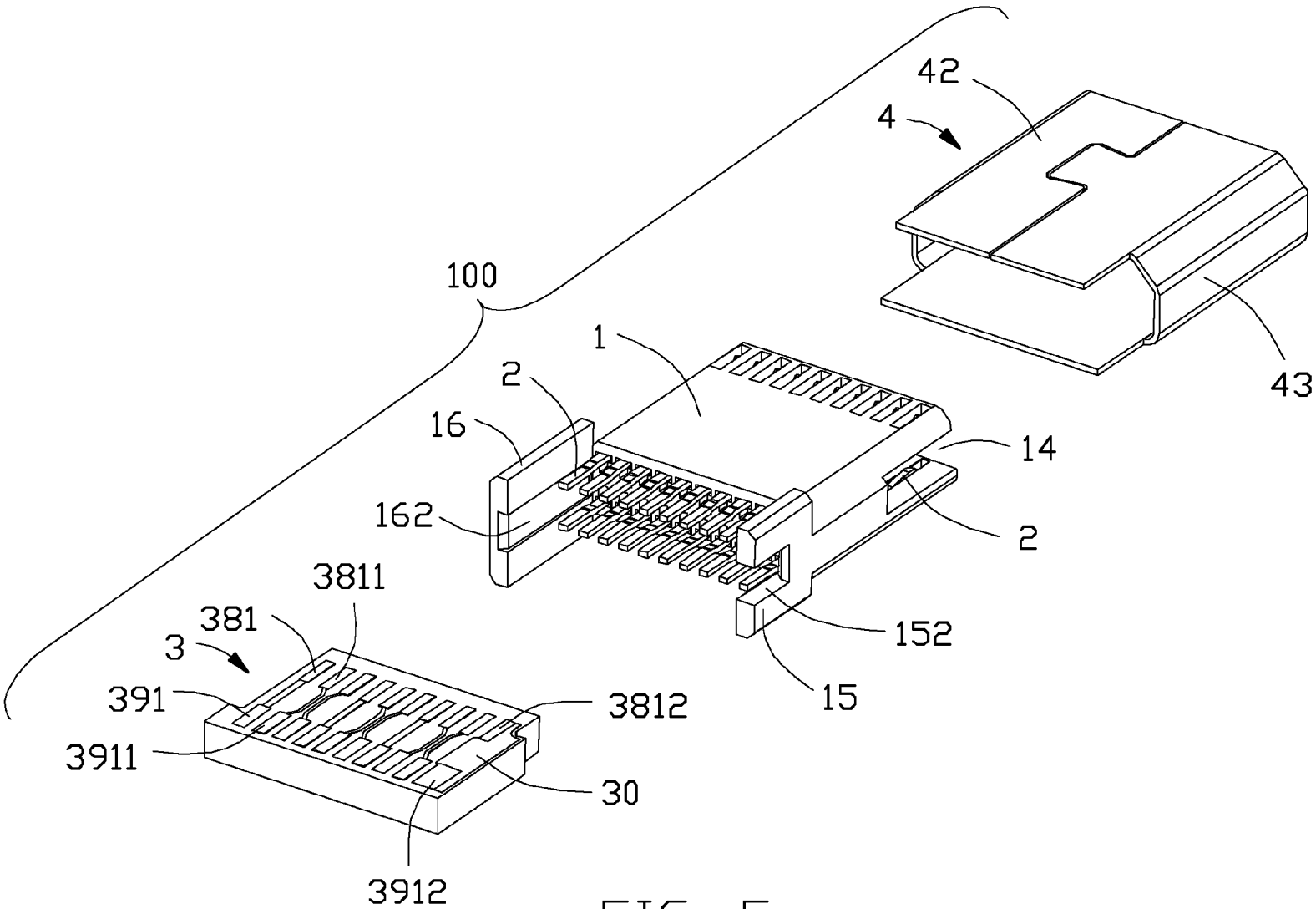
FIG. 5 is partially exploded, perspective view of the electrical connector as shown in FIG. 2.
Figure 6:
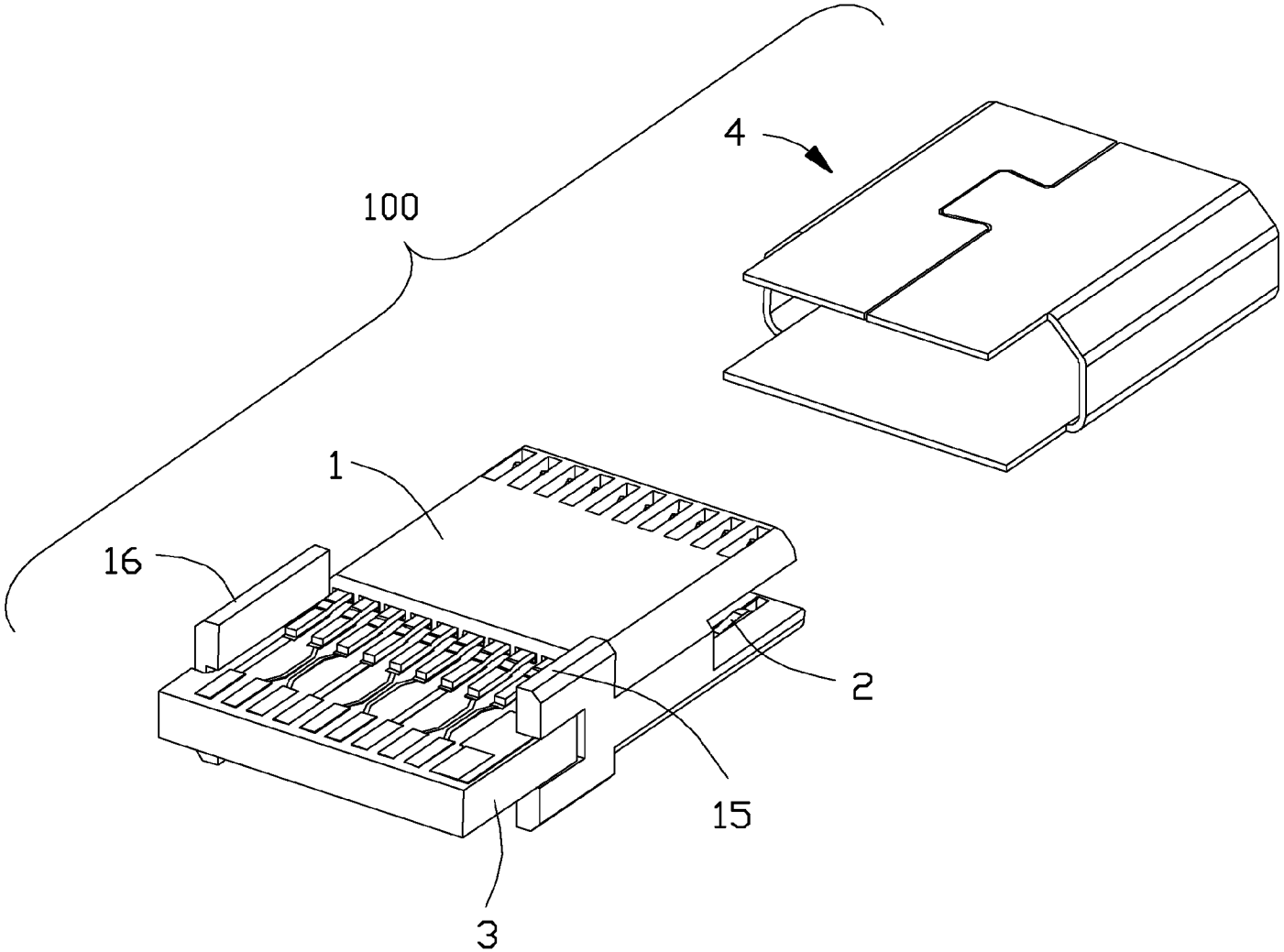
FIG. 6 is another partially exploded, perspective view of the electrical connector as shown in FIG. 2.

Reference will now be made in detail to the preferred embodiment of the present invention.

Referring to FIGS. 1-7, an electrical connector 100 in accordance with the present invention is configured for mating with a plug connector along a front-to-back direction. The electrical connector 100 comprises an insulative housing 1 essentially defining a front mating port and a rear connecting port, a plurality of contacts 2 received in the housing 1, an inner board 3 assembled to the housing 1 and electrically connected to the contacts 2, a metal shell 4 enclosing the housing 1. The inner board 3 has a top surface 31, and a bottom surface 32. Additionally, a cable (not shown) which has a number of conductive wires (not shown) could be electrically connected to the inner board 3. The shell 4 includes a top shell 41, a bottom shell 42 opposing to the top shell 41, and a pair of side shell 43 connecting the top shell 41 and the bottom shell 42. Each of the top shell 41 and the bottom shell 42 has a length greater than the side shell 43 in the front-to-back direction.

The housing 1 has a base portion 11, a top tongue 12 and a bottom tongue 13 extending forwardly from a top wall 111 and a bottom wall 112 of the base portion 11, respectively, and defining a receiving cavity 14 therebetween, a first side wall 16 and a second side wall 15 extending backwardly from an opposite side surface 113 of the base portion 11 and defining a mounting room or receiving space 17 therebetween. The receiving cavity 14 is configured for receiving a mating plug connector (not shown) along a front-to-back direction. A number of receiving slots 10 defined on both of the top tongue 12 and the bottom tongue 13. Each receiving slots 10 receives a part of the contact 2. A number of mounting holes 115 extend through a rear wall 114 of the base portion 11 and communicate the receiving cavity 14 with the mounting room 17, such that the contacts 2 could be inserted into the mounting hole 115 respectively, from the mounting room 17 into the receiving cavity 14 in a back-to-front direction. In this embodiment, the mounting hole 115 has a wide portion 117 configured for mounting the contact 2, and a narrow portion 116.

Each contact 2 has a mating portion 202, a mounting portion 203, and a middle portion 201 extending between the mating portion 202 and the mounting portion 203. The mating portion 202 has a width smaller than the middle portion 201 such that the mating portion 202 could be inserted through the narrow portion 116 before the middle portion 201 is fixed into the wide portion 117. The contacts 2 are arranged into a first row of upper contacts 21 and a second row of lower contacts 22. The mating portion 202 of the upper contact 21 is located into the receiving slot 10 of the top tongue 12 respectively, and the mating portion 202 of the lower contact 22 is located into the receiving slot 10 of the bottom tongue 13 respectively. Thus, a front receiving passageway 205 is defined between the upper contacts 21 and the lower contacts 22. The front receiving passageway is configured for receiving an outer board (not shown) of the mating plug connector. Further more, a rear receiving passageway 204 is defined opposing to the front receiving passageway 205. The rear receiving passageway 204 is configured for receiving a front edge 34 of the inner board 3.

In this embodiment, the upper contacts 21 includes three pairs of signal contacts 211 each configured for transmitting differential signal, three ground contacts 212 each positioned adjacent to a pair of signal contacts 211, and a power contact 213 configured for transmitting current flow. The lower contacts 22 includes three pairs of signal contacts 221 each configured for transmitting differential signal, three ground contacts 222 each positioned adjacent to a pair of signal contacts 221, and a power contact 223 configured for transmitting current flow too.

The inner board 3 has an irregular shape including a base 33, a front edge 34, a rear edge 35 opposing to the front edge 34, a top surface 31 and a bottom surface 32 extending between the front edge 34 and the rear edge 35, a first flange 37 outwardly extending from the base 33, and a second flange 36 outwardly extending opposing to the first flange 37. The base 33 of the inner board 3 has a front connecting region 38 and a rear connecting region 39 on both of the top surface 31 and the bottom surface 32. The front connecting region 38 has a plurality of front terminals 381 configured for electrically connecting with the mounting portion 203 of the upper contacts 21 and the lower contacts 22 respectively. The electrically connecting could be resilient contact or welding. The rear connecting region 39 has a plurality of rear terminals 391 each configured for soldering with a conductive wire.

The front terminals 381 of the top surface 31 include a number of first terminals 3811 configured for connecting with the ground contacts 212 and the signal contacts 211, and a second terminal 3812 configured for connecting with the power contact 213. The front terminals 381 of the bottom surface 32 include a number of first terminals 3811 configured for connecting with the ground contacts 222 and the signal contacts 221, and a second terminal 3812 configured for connecting with the power contact 223. That means the front terminals 381 have a same layout on both top surface 31 and the bottom surface 32. Meanwhile, the rear terminals 391 of the top surface 31 include a number of third terminals 3911, and a fourth terminal 3912 configured for connecting with a wire transmitting current flow. The front terminals 391 of the bottom surface 32 include a number of third terminals 3911, and a fourth terminal 3912 configured for connecting with a wire transmitting current flow too. It means that the rear terminals 391 have a same layout on both top surface 31 and the bottom surface 32 too. A number of first circuits electrically connect between the first terminal 3811 and the third terminal 3911, and a second circuit 30 electrically connects between the second terminal 3812 and the fourth terminal 3912. Selectively, the second circuit 30 has a width more than one millimeter, thus the second circuit 30 could transmit a current flow having a maximization around two amperes.

Figure 7:
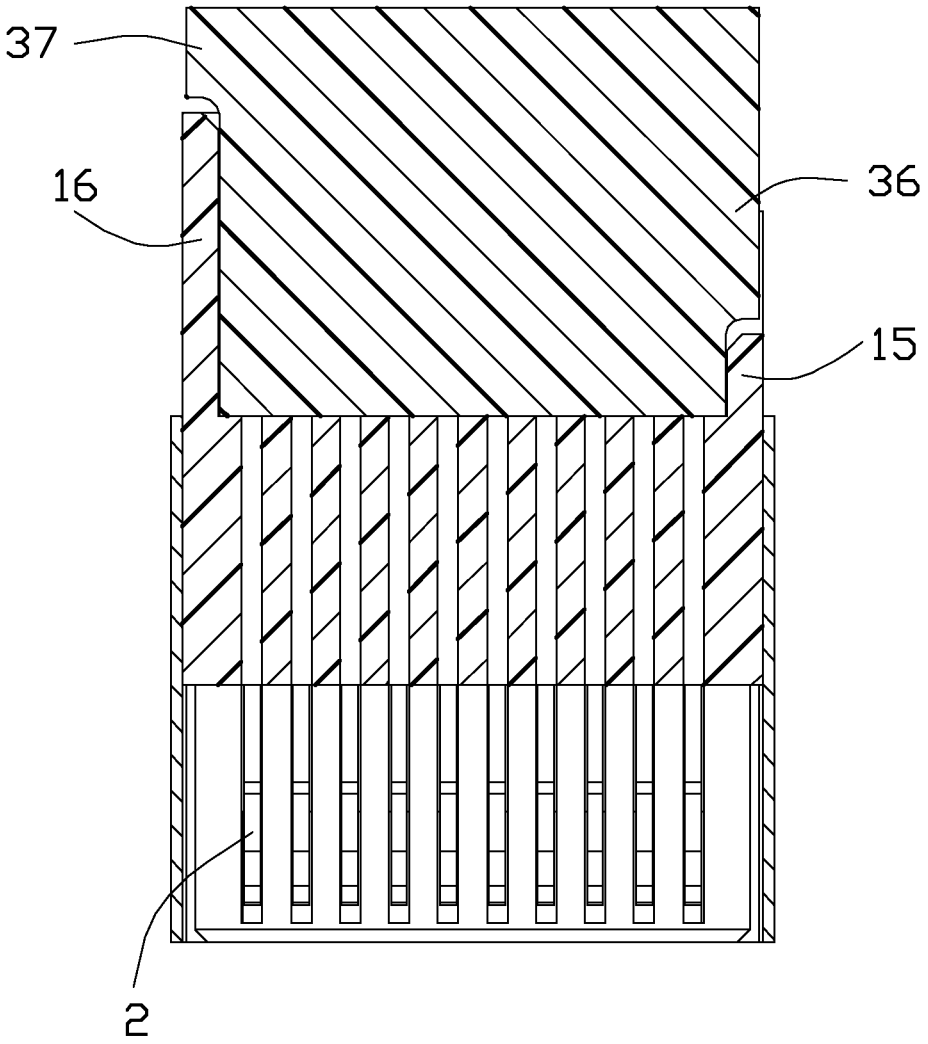
FIG. 7 is a cross-section view of FIG. 1 taken along line 7-7 to show the correct mounting manner.
Figure 7A:
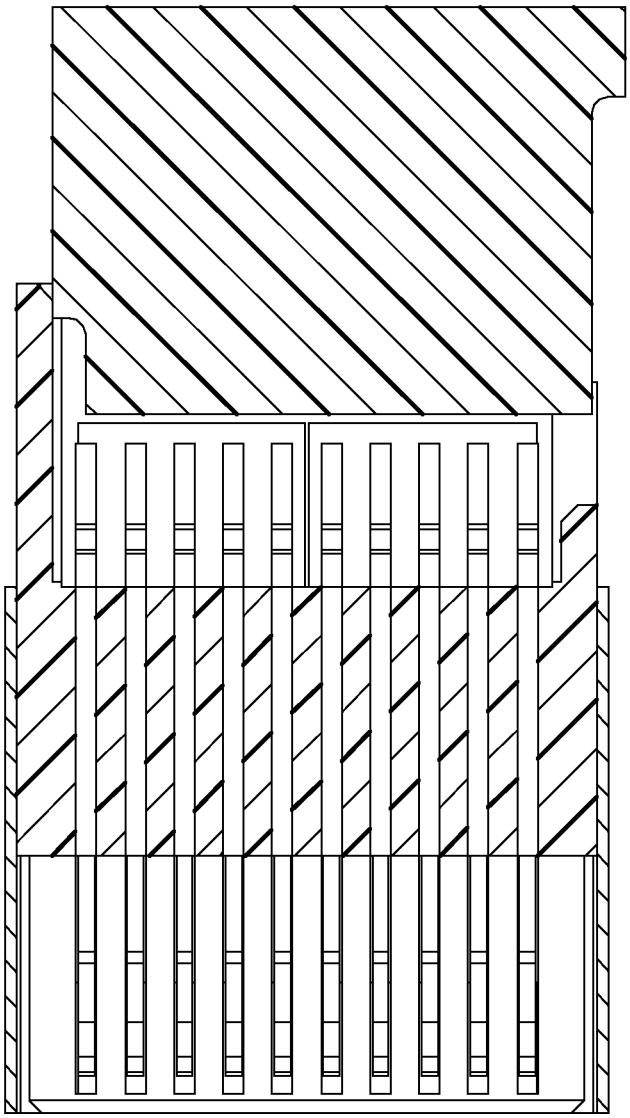
FIG. 7(A) is a cross-section view of FIG. 1 to show the incorrect mounting manner.

The inner board 3 is adapted to be inserted into the mounting room 17 of the housing 1 along a back-to-front direction while the top surface 31 at an upwardly status. In order to prevent the inner board 3 is inserted at a wrong statement, the first side wall 16 defined a groove 162 on an inner surface 161, and the second side wall 15 defined a cutout 152 front a rear end 151. The inner board 3 could be inserted into the mounting room 17 when the first flange 37 aligned with the groove 162 and the second flange 36 cooperated with the cutout 152. On the other hand, the inner board 3 could not be inserted into the mounting room 17 when the first flange 37 cooperated with the cutout 152 due to the width between the first flange 37 and the second flange 36 is greater than the width between the first side wall 16 and the second side wall 15. Further more, the first side wall 16 has a length greater than the second wall 15 in the front-to-back direction, and the first flange 37 has a length smaller than the second flange 36 in the front-to-back direction too. In brief, the housing includes a front mating port for mating with a complementary connector, and a rear connecting port for connecting to an internal printed circuit board wherein the connecting port includes a pair of side walls with different confrontation positions and different deep grooves in the front-to-back direction so as to efficiently block the incorrect orientation of the internal printed circuit board during assembly at the initial stage. In other words, when the internal printed circuit board is inserted into the receiving space correctly, the first flange is snugly received within the first groove and the second flange is snugly received within the cutout wherein two sides of the internal printed circuit board are located within a transverse boundary of the opposite first and second side walls in a top view as shown in FIG. 7. Differently, when the internal printed circuit board is inserted into the space in an upside-down manner, the whole internal printed circuit board will be forced to laterally moved beyond the original transverse boundary defined by the opposite first and second side walls by confrontation between the first side wall and the second flange of the internal printed circuit board in the transverse direction so as to be identified/noticed easily at the early stage as shown in FIG. 7(A).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector configured for connecting with a cable, comprising:

a housing having a base portion, a first side wall, and a second side wall, the base portion defining a receiving cavity for receiving a mating connector along a front-to-back direction, the first and second side walls being parallel to each other and backwardly extending from the base portion to define a mounting room;

a plurality of contacts supported by said housing, said contacts each having a mating portion exposed into the receiving cavity and a mounting portion extending into the mounting room; and an inner board inserted into the mounting room along a back-to-front direction for supporting the mounting portions, said inner board having a first flange cooperated with the first side wall and a second flange cooperated with the second side wall;

wherein in the front-to-back direction, the first side wall has a length greater than the second wall, and the first flange has a length smaller than the second flange.

2. The connector as claimed in claim 1, wherein the first side wall has a groove configured for engaging at least a part of the first flange, and the second side wall has a cutout configured for engaging a part of the second flange.

3. The connector as claimed in claim 1, wherein the contacts are arranged into an upper row and a lower row of contacts, and the inner board has a top surface and a bottom surface each having a plurality of front terminals for connecting with the mounting portions of the upper contacts and the lower contacts, respectively.

4. The connector as claimed in claim 3, wherein the inner board has a plurality of rear terminals positioned on a rear side of both the top and bottom surfaces for connecting with a cable.

5. The connector as claimed in claim 4, wherein the rear terminals include a plurality of signal terminals and a power terminal located adjacent to the first flange of the inner board.

6. The connector as claimed in claim 5, wherein the power terminal has a width greater than the signal terminal in a horizontal and transverse direction vertical to the front-to-back direction.

7. The connector as claimed in claim 5, wherein the power terminal extends at least partially onto the first flange.

8. The connector as claimed in claim 5, wherein the power terminal has a width greater than 1 millimeter along a horizontal and transverse direction vertical to the front-to-back direction.

9. The connector as claimed in claim 1, further including a cage surrounding the base portion of the housing.

10. The connector as claimed in claim 1, wherein the base portion of the housing has a plurality of mounting holes, and each of the contacts has a middle portion extending between the mating portion and the mounting portion, said mounting hole including a wide portion configured for fixing the middle portion of the contact and a narrow portion communicating the receiving cavity with the mounting room.

11. A cable end connector comprising:

a cable including a plurality of conductive wires;

a housing having a base portion, a first side wall, and a second side wall, the base portion defining a receiving cavity for receiving a mating connector along a front-to-back direction, the first and second side walls being parallel to each other and backwardly extending from the base portion to define a mounting room;

a plurality of contacts supported by said housing, said contacts each having a mating portion exposed into the receiving cavity, a mounting portion extending into the mounting room for connecting with each wires; and an inner board inserted into the mounting room along a back-to-front direction, said inner board having a first flange aligned with the first side wall and a second flange engaged with the second side wall;

wherein the first side wall has a length greater than the second wall, and the first flange has a length smaller than the second flange in a front-to-back direction.

12. The cable end connector as claimed in claim 11, wherein the first side wall has a groove configured for engaging at least a part of the first flange, and the second side wall has a cutout configured for engaging a part of the second flange.

13. The cable end connector as claimed in claim 11, wherein the inner board has a plurality of front terminals configured for connecting with the mounting portions of the contacts, and a plurality of rear terminals positioned on a rear side of both top and bottom surfaces configured for connecting with the wires, respectively.

14. The cable end connector as claimed in claim 13, wherein the rear terminals include a plurality of signal terminals and at least one power terminal located adjacent to the first flange of the inner board.

15. The cable end connector as claimed in claim 14, wherein the at least one power terminal has a width greater than the signal terminal in a horizontal and transverse direction vertical to the front-to-back direction.

16. The cable end connector as claimed in claim 11, wherein the base portion of the housing has a plurality of mounting holes, and each of the contacts has a middle portion extending between the mating portion and the mounting portion, said mounting hole including a wide portion configured for fixing the middle portion of the contact and a narrow portion communicating the receiving cavity with the mounting room.

17. A cable connector assembly comprising:

an insulative housing defining, along a front-to-back direction, a front mating port, and a rear connecting port with opposite first and second side walls spaced from each other with a receiving space therebetween in a transverse direction perpendicular to said front-to-back direction;

the first side wall extending rearwardly beyond the second side wall, and the second side wall including a cutout extending forwardly from a rear edge thereof along the front-to-back direction, the first side wall including a groove extending forwardly from a rear edge thereof along the front-to-back direction;

a plurality of contacts disposed in the housing with front contacting sections exposed in the front mating port and rear connecting sections exposed in the rear connecting port; and an internal printed circuit board located behind the housing and mechanically and electrically connected to the contacts, said internal printed circuit board having opposite first and second side flanges on opposite first and second lateral sides in said transverse direction, a front end of said first side flange being located behind a front end of said second side flange in the front-to-back direction; wherein when the internal printed circuit board is inserted into the receiving space correctly, the first lateral side is snugly received within the first groove and the second flange is snugly received within the cutout wherein the opposite first and second lateral sides of the internal printed circuit board are located within a transverse boundary of the opposite first and second side walls in a top view; in opposite, when the internal printed circuit board is inserted into the space in an upside-down manner, the whole internal printed circuit board will be forced to laterally moved beyond the original transverse boundary by confrontation between the first side wall and the second flange of the internal printed circuit board along the transverse direction so as to be noticed easily.

18. The cable connector assembly as claimed in claim 17, wherein said groove does not extend through the first side wall but only taking a portion of the first side wall in the transverse direction.

19. The cable connector assembly as claimed in claim 18, wherein a depth of the groove in the transverse direction is gradually increased along the front-to-back direction, and the front end of the first flange is essentially received in the groove.

20. The cable connector assembly as claimed in claim 17, wherein after correctly assembled, the first flange is essentially exposed outside of the groove while the second flange has a significant portion received within the cutout with a distance along said front-to-back direction.

* * * * *